US006932462B2

(12) United States Patent
Watanabe

(10) Patent No.: US 6,932,462 B2
(45) Date of Patent: Aug. 23, 2005

(54) INK JET HEAD AND INK JET RECORDING APPARATUS

(75) Inventor: Toshiaki Watanabe, Chiba (JP)

(73) Assignee: SII Printek Inc., Chiba (JP)

( * ) Notice: Subject to any disclaimer, the term of this patent is extended or adjusted under 35 U.S.C. 154(b) by 11 days.

(21) Appl. No.: 10/612,563

(22) Filed: Jul. 2, 2003

(65) Prior Publication Data

US 2004/0125179 A1 Jul. 1, 2004

(30) Foreign Application Priority Data

Aug. 27, 2002 (JP) ..... 2002-247379

(51) Int. Cl.[7] ..... B41J 2/05
(52) U.S. Cl. ..... 347/65
(58) Field of Search ..... 347/20, 47, 54, 347/65, 66, 85, 86, 87, 92, 93

(56) References Cited

U.S. PATENT DOCUMENTS 5,216,446 A * 6/1993 Satoi et al. ..... 347/65
5,280,299 A * 1/1994 Saikawa et al. ..... 347/87
5,486,846 A * 1/1996 Comer et al. ..... 345/168
5,495,272 A * 2/1996 Yamaguchi ..... 347/28
5,671,000 A * 9/1997 Hirabayashi et al. ..... 347/86
6,120,140 A * 9/2000 Hirosawa et al. ..... 347/93

* cited by examiner

*Primary Examiner*—Anh T. N. Vo
(74) *Attorney, Agent, or Firm*—Adams & Wilks

(57) ABSTRACT

An ink jet head has grooves, an ink flow path for transporting ink from an ink storing member to the grooves via an ink chamber, and a filter disposed in the ink flow path. The ink flow path has a communicating passage connected to the ink storing member, an ink introduction passage connected to the communicating passage for transporting ink along a flow direction generally perpendicular to a longitudinal direction of each of the grooves, an ink reservoir connected to the ink introduction passage and in which the filter is disposed, and an ink supply passage connected to the ink reservoir for supplying ink to the ink chamber. The ink supply passage is inclined downwardly toward the ink chamber relative to a horizontal line disposed generally parallel to the flow direction of ink in the ink introduction passage.

14 Claims, 11 Drawing Sheets

INK JET HEAD AND INK JET RECORDING APPARATUS

BACKGROUND OF THE INVENTION

1. Field of the Invention

The present invention relates to an ink jet head applied, for example, to a printer, a facsimile, or the like, and also relates to an ink jet recording apparatus equipped with the ink let head.

2. Description of the Related Art

There is known a conventional ink jet recording apparatus that records characters and images on a recording medium by using an ink jet head having a plurality of nozzles for discharging ink. In this ink jet recording apparatus, the nozzles of the ink jet head are formed in a head holder in such a position as to face the recording medium. The head holder is mounted on a carriage and performs scanning in a direction perpendicular to a transport direction of the recording medium.

FIG. 11 is an exploded schematic diagram showing an example of such an ink jet head. As shown in FIG. 11, a plurality of grooves 112 are formed in parallel in a piezo-electric ceramic plate 111, and the grooves 112 are separated by side walls 113. One end portion of each groove 112 in the longitudinal direction extends up to one end face of the piezo-electric ceramic plate 111, whereas the other end portion of each groove 112 does not extend up to the other end face of the piezo-electric ceramic plate 111 and gradually decreases in depth. Electrodes 114 for applying drive voltages are formed in the opening-side surfaces of both side walls 113 of each groove 112 so as to extend in the longitudinal direction thereof.

An ink chamber plate 116, which defines a common ink chamber 115 communicating with the end portion of each groove 112 where the depth is decreased, is joined to the piezo-electric ceramic plate 111 on the side where the grooves 112 are opened.

A flow path substrate 118, which seals one side of the common ink chamber 115 and has a communicating hole 117 being in communication with an ink flow path for supplying ink to the common ink chamber 115, is fixed onto the ink chamber plate 116.

An ink reservoir 119, which constitutes a portion of an ink flow path for supplying ink into the common ink chamber 115 via the communicating hole 117, is formed in this type of flow path substrate. A finely meshed filter 120 made of stainless steel (SUS), for example, is formed within the ink reservoir 119.

A nozzle plate 121 is joined to the end face of the joined body of the piezo-electric ceramic plate 111 and the ink chamber plate 116 on the side where the grooves 112 are opened. Nozzle apertures 122 are formed in the nozzle plate 121 in such positions as to face the respective grooves 112 of the nozzle plate 121.

In the ink jet head constructed in the above-mentioned manner, when the ink is supplied to the grooves 112 via the communicating hole 117 and predetermined driving electric fields are applied to both side walls 113 of a predetermined groove 112 through the electrodes 114, the side walls 113 are deformed to change the capacity of the predetermined groove 112 so that the ink can be discharged from the groove 112 through the nozzle aperture 122.

Further, with an ink jet recording apparatus on which an ink jet head having this type of structure is mounted, for example, it is necessary to implement a filling operation for supplying ink from an ink reservoir at start-up, before printing, and the like, at a predetermined timing, to fill the inside of the grooves with fresh ink, or a filling operation for preventing clogging of nozzle apertures 122 by discharging ink from the inside of the grooves, known as a cleaning operation.

These types of ink filling operations are performed, for example, by sealing an end of a head tip of the ink jet head by using a cap or the like, and absorbing the inside of the grooves 112 from the nozzle apertures 122 with an absorbing apparatus such as a pump. The ink from the ink reservoir is thus filled within the respective grooves 112. The ink within the grooves 112 is then discharged from the nozzle apertures 122. With this type of ink filling operation, air bubbles in internal spaces of the head, for example, the ink reservoir 119, the common ink chamber 115, or inside each of the grooves 112, are also discharged from the nozzle apertures 122 along with the ink.

However, with a conventional ink jet head, there are relatively large volumetric changes in the ink that passes through the ink reservoir, which is a space around the filter, and this invites a reduction in the ink flow rate within the ink reservoir during the aforementioned ink filling operation, for instance.

If the ink flow rate decreases within this kind of ink reservoir, then air bubbles generated in the internal spaces of the head, that is in the ink reservoir, the common ink chamber, or the inside of each of the grooves cannot be efficiently discharged from the nozzle apertures during the ink filling operation, and therefore the air bubbles remain in the internal spaces of the head after the ink filling operation.

The air bubbles thus remaining in the internal spaces of the head become causes that exert a harmful influence on a head vibration system. For example, for cases in which the air bubbles remain within the grooves, the internal pressure of the grooves during the ink discharge operation will be absorbed by the air bubbles, and therefore there is a problem in that a predetermined pressure is not applied to the ink within each of the grooves, and the ink discharge characteristics are thus reduced. On the other hand, for cases in which there are air bubbles remaining in ink flow paths such as the common ink chamber, the ink reservoir, and the like, this becomes a problem in that it invites an insufficient supply of ink to each of the grooves, and as a result, the ink discharge characteristics are thus reduced.

Further, the location at which these types of air bubbles are generated differs depending upon the ink filling operation, and therefore dispersion in the ink discharge characteristics develops, ink supply insufficiencies develop, and each problem develops irregularly. The ink discharge characteristics are consequently reduced, and lastly this invites a reduction in printing quality.

In addition, if ink discharge is performed in the state in which air bubbles remain in the internal spaces of the head, then there is also a problem, for example, in that the air bubbles are discharged form the nozzle apertures along with the ink, and this invites printing failure.

There is also a problem in that each of the aforementioned problems becomes markedly worse for cases of using water based ink having poor air bubble permeability with respect to the ink, and for cases of using large sized ink jet heads with which the amount of ink discharged within a unit time is large.

SUMMARY OF THE INVENTION

In view of the above-mentioned circumstances, an object of the present invention is to provide an ink jet head, and an ink jet recording apparatus, capable of preventing reductions and dispersions in ink discharge characteristics, along with preventing printing failure, and capable of improving printing quality.

According to a first mode of the present invention made for solving the above-mentioned object, there is provided an ink jet head including: a plurality of grooves each connected to a nozzle aperture; a common ink chamber to which each of the grooves is connected; ink storing means for storing ink; an ink flow path that connects the common ink chamber and the ink storing means to each other; and a filter that is disposed in a portion of the ink flow path. The ink jet head is characterized in that: thin plate shaped spaces are defined in an upstream side and a downstream side by forming mutually opposing partitions before and after the filter in the flow path; in the upstream space of the upstream side, a thin plate shaped ink introduction passage is connected to one end side of the filter in a directional orthogonal to the direction in which the grooves of the filter are arranged in parallel, extending over the direction in which the grooves are arranged in parallel; in the downstream space of the downstream side, a thin plate shaped ink supply passage for supplying ink to the common ink chamber is connected to the other end side of the filter, extending over the direction in which the grooves are arranged in parallel; one end side of a tubular communicating passage, of which the other end is connected to the ink storing means, is connected to a side opposite to that of the upstream space of the ink introduction passage; and dimensions of the ink introduction passage, the ink supply passage, the upstream space, and the downstream space in a thickness direction of the thin plate shaped spaces are each smaller than an inner diameter of the communicating passage.

According to a second mode of the present invention, with the arrangement in the first mode of the invention, the ink jet head is characterized in that: the filter is disposed in a vertical direction; the ink introduction passage is connected to a lower portion side in a vertical direction of the upstream space; and the ink supply passage is connected to an upper portion side in a vertical direction According to a third mode of the present invention, with the arrangement in the first mode of the invention, the ink jet head is characterized in that: the filter is disposed in a horizontal direction; the upstream space is defined on a lower side in a vertical direction of the filter; and the downstream space is defined on an upper side in a vertical direction of the filter.

According to a fourth mode of the present invention, with the arrangement in any one of the first to third modes of the invention, the ink jet head is characterized in that the dimensions of the ink introduction passage, the ink supply passage, the upstream space, and the downstream space in the thickness direction of the thin plate shaped spaces are substantially identical to one another.

According to a fifth mode of the present invention, with the arrangement in any one of the first to fourth modes of the invention, the ink jet head is characterized in that the dimensions of the ink introduction passage, the ink supply passage, the upstream space, and the downstream space in the thickness direction of the thin plate shaped spaces are each equal to or less than 1.0 mm.

According to a sixth mode of the present invention, with the arrangement in any one of the first to fifth modes of the invention, the ink jet head is characterized in that the ink supply passage is connected to the common ink chamber with one end side, opposite to the other end side that is connected to the downstream space, so as to be inclined downward in the vertical direction by a predetermined amount.

According to a seventh mode of the present invention, there is provided an ink jet recording apparatus including the ink jet head according to any one of the first to sixth modes.

Air bubbles that remain within the internal spaces of the head can be reduced to a minimum with the present invention by making ink volumetric changes smaller between the upstream spaces and down stream spaces before and after the filter in the flow path, thus suppressing reductions in the ink flow rate. Reductions and dispersions in the ink discharge characteristics can thus be prevented, printing failure can be prevented, and the printing quality can be improved.

DETAILED DESCRIPTION OF THE PREFERRED EMBODIMENTS

The present invention will be explained in detail below based on embodiment modes of the invention.

Embodiment Mode 1

Figure 1:
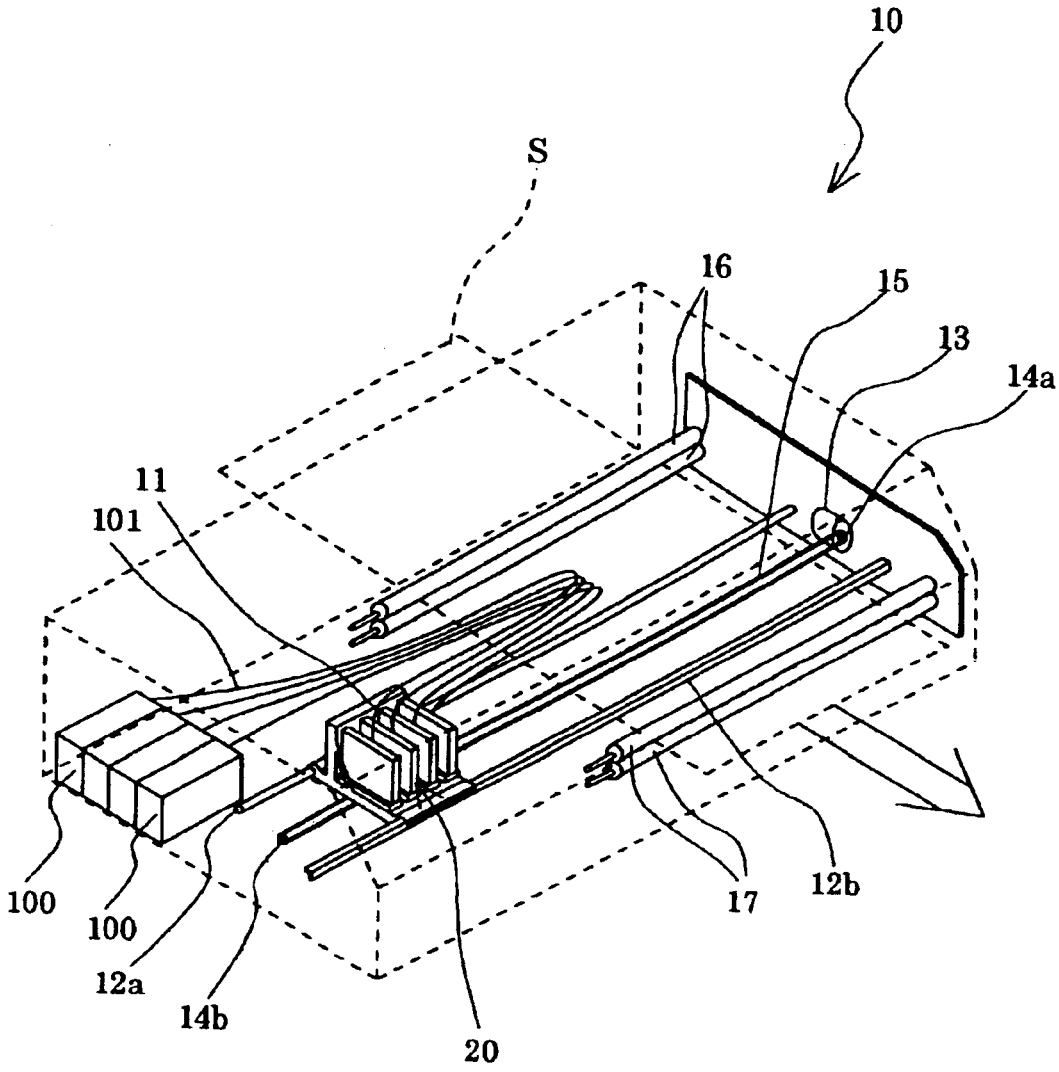
FIG. 1 is a schematic perspective diagram of an ink jet recording apparatus according to Embodiment Mode 1 of the present invention.

FIG. 1 is a schematic perspective diagram of an ink jet recording apparatus according to Embodiment Mode 1 of the present invention.

As shown in FIG. 1, an ink jet recording apparatus 10 of this embodiment mode is provided with: a plurality of ink jet heads 20 established for each color; a carriage 11, on which the plural ink jet heads 20 are mounted in parallel in a main scanning direction; and ink reservoirs 100 that are a portion of ink storing means for supplying ink through ink supply tubes 101 made from flexible tubing. The carriage 11 is mounted on a pair of guide rails 12*a* and 12*b* so as to be able to move freely in an axial direction. Further, a drive motor 13 is provided in one end side of the guide rails 12*a* and 12*b*, and a driving force from the drive motor 13 causes movement of the carriage 11 along a timing belt 15 hung between a pulley 14*a* coupled to the driver motor 13, and a pulley 14*b* provided to the other end side of the guide rails 12*a* and 12*b*.

Further, pairs of transport rollers 16 and 17 are provided at both end portion sides in a direction orthogonal to the transport direction of the carriage 11, following the guide rails 12*a* and 12*b*, respectively. The transport rollers 16 and 17 transport a recording medium S below the carriage 11, and in a direction that is orthogonal to the transport direction of the carriage 11.

By scanning the carriage 11 in a direction that is orthogonal to the transport direction of the recording medium S while continuing to transport the recording medium S by the transport rollers 16 and 17, characters, images, and the like are recorded on the recording medium S by the ink heads 20.

Note that each of the ink heads 20 is a large sized ink jet head that discharges a single color of ink. For example, in this embodiment mode, four ink jet heads corresponding to four water based ink colors, black (B), yellow (Y), magenta (M), and cyan (C), are mounted in parallel on the carriage 11.

Further, the ink reservoirs 100 that are filled with respective colors of ink are provided at positions that do not interfere with motion in the main scanning direction of the carriage 11 or motion of the recording medium S, and that are lower by a predetermined amount than nozzle apertures of the ink jet heads 20 so as to impart a negative pressure within the ink jet heads 20.

Note that, with this type of ink jet recording apparatus, there are performed filling operations for filling fresh ink within grooves of the ink jet heads 20 at a predetermined timing such as during start-up, before starting printing, or the like, or at an arbitrary timing, and cleaning operations for discharging ink, and air bubbles mixed into the ink, remaining within the grooves from the nozzle apertures by filling ink from the ink reservoirs 100 within the grooves of the ink jet heads 20.

Figure 2:
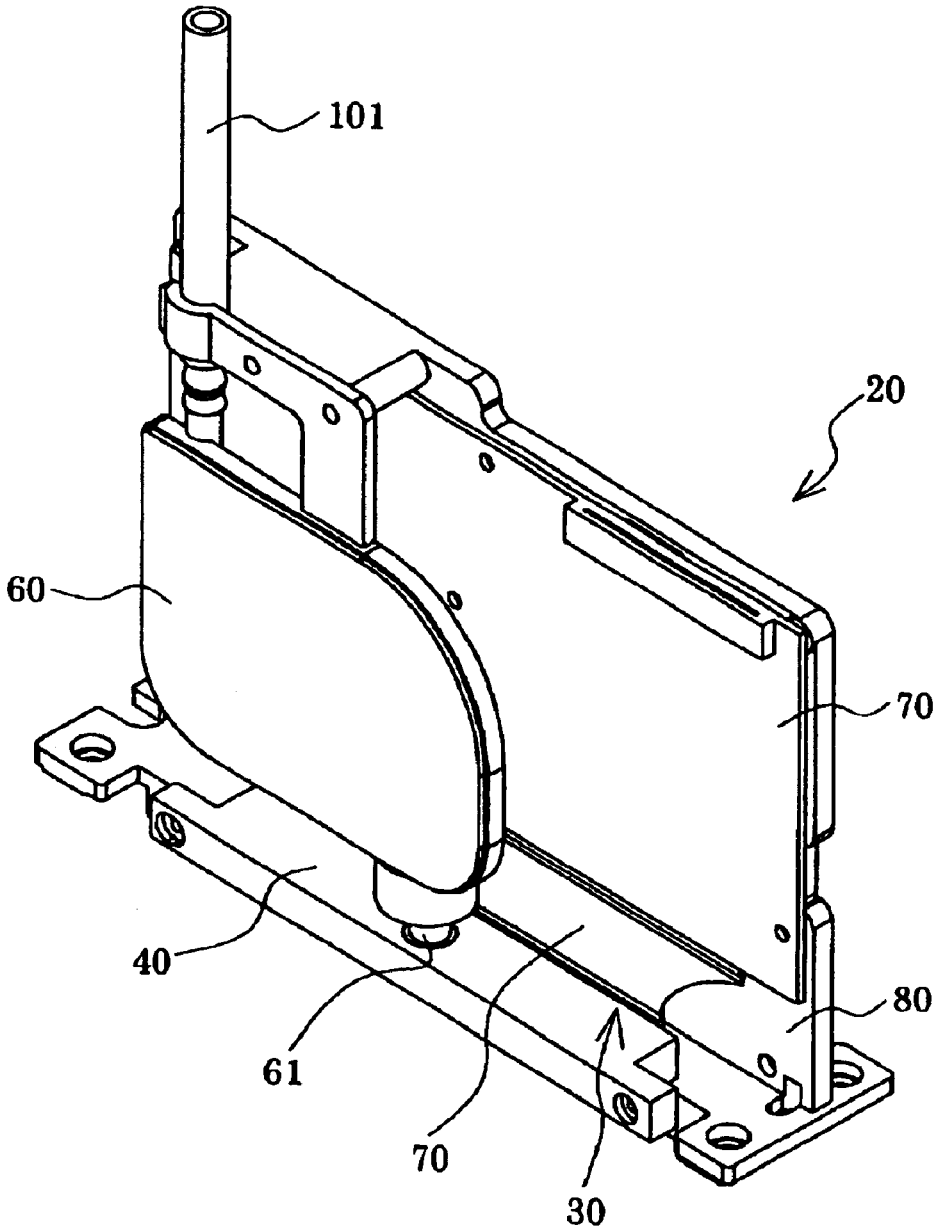
FIG. 2 is a perspective diagram of an ink jet head according to Embodiment Mode 1 of the present invention.
Figure 3:
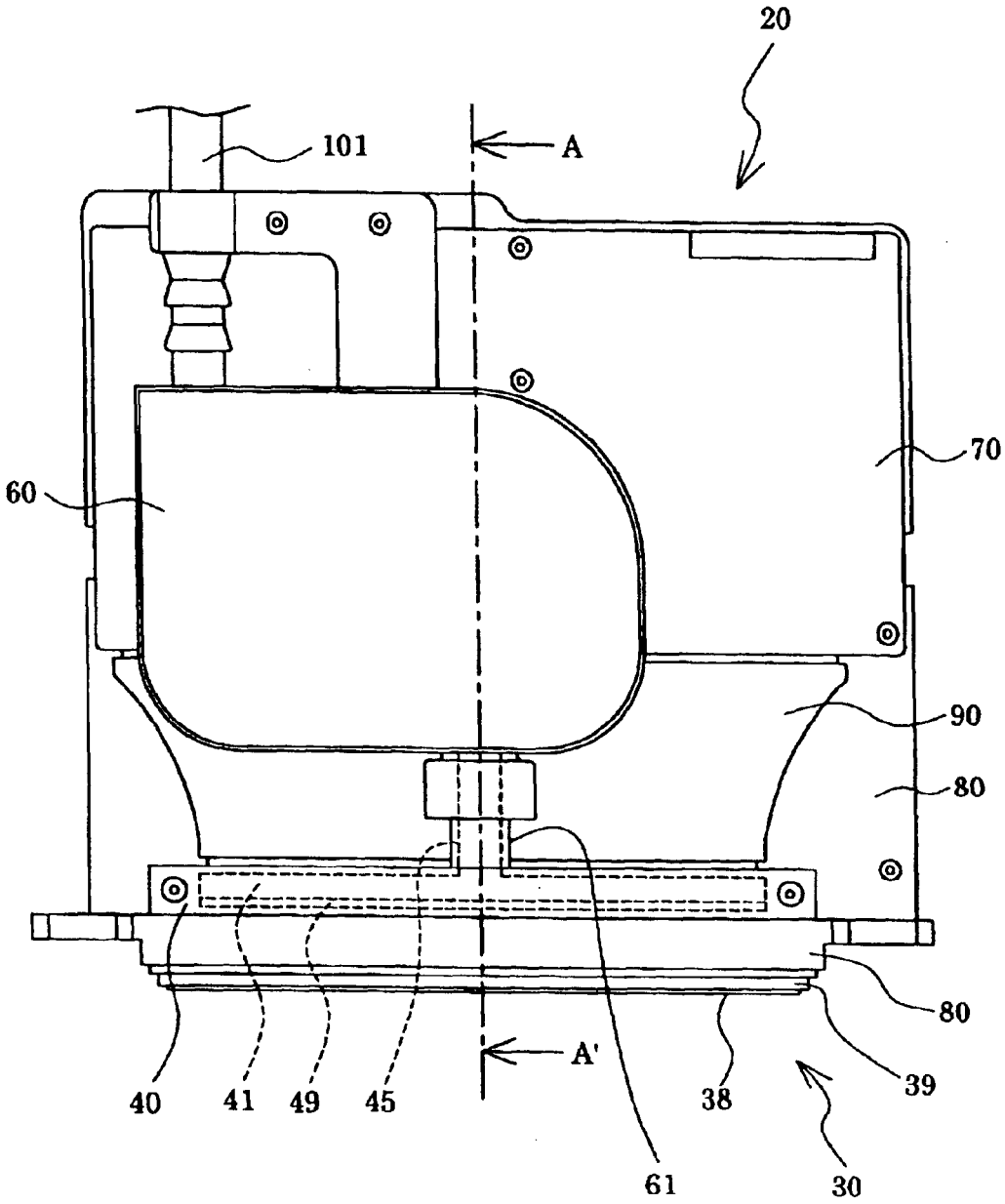
FIG. 3 is a plan view diagram of the ink jet head according to Embodiment Mode 1 of the present invention.
Figure 4A:
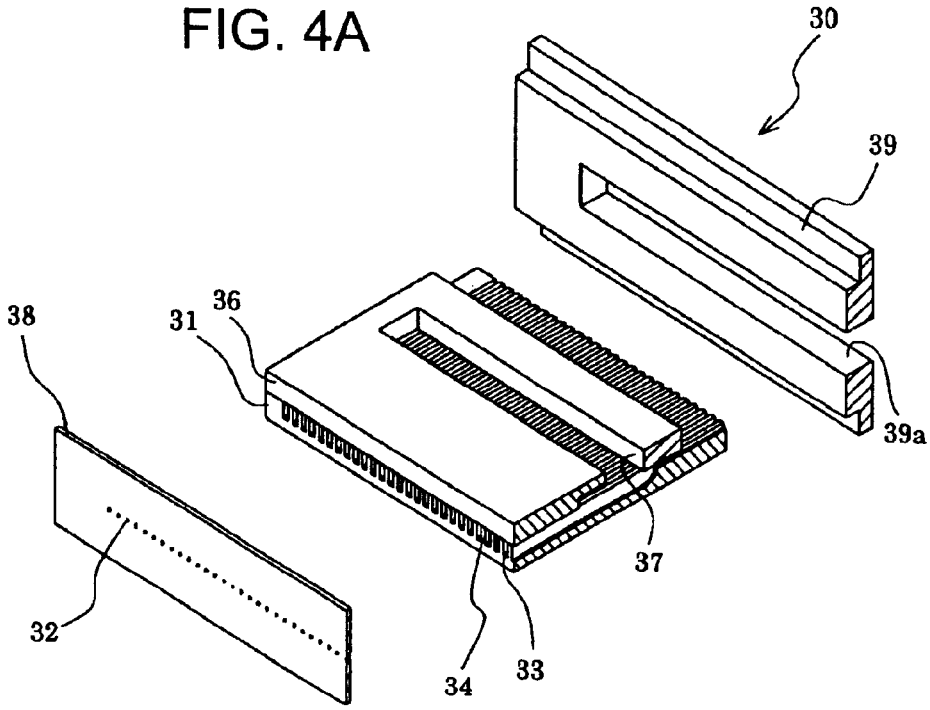
FIGS. 4A and 4B are schematic perspective diagrams of a head tip that constitutes a portion of the ink jet head according to Embodiment Mode 1 of the present invention.
Figure 4B:
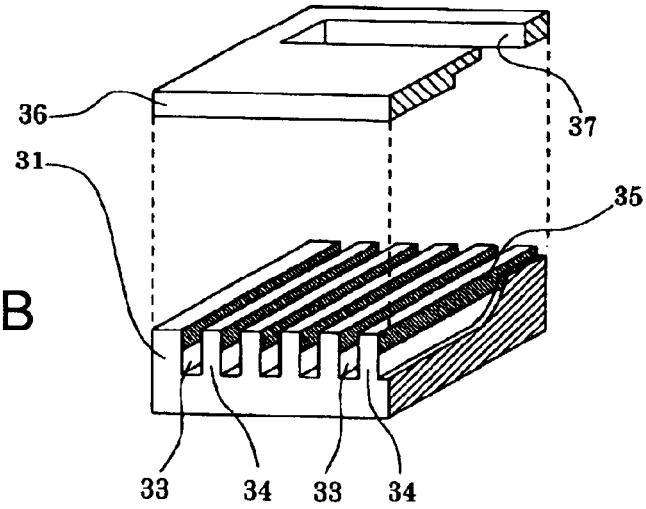
Figure 5:
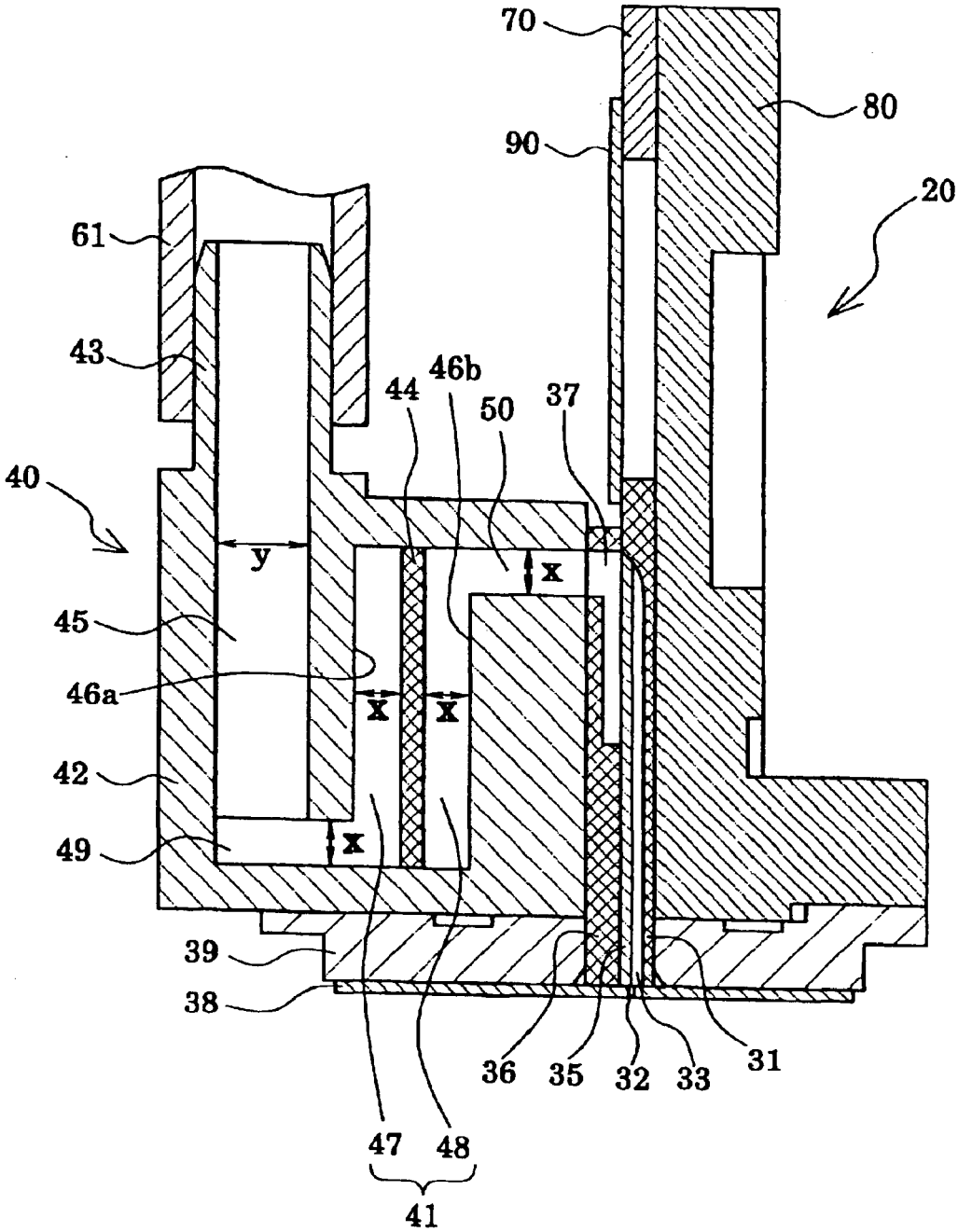
FIG. 5 is a cross section along a line segment A–A' of the ink jet head shown in FIG. 3 according to Embodiment Mode 1 of the present invention.

The ink jet heads 20 mounted on the aforementioned ink jet recording apparatus are explained here while referring to FIG. 2 to FIG. 5. Note that FIG. 2 is a perspective diagram of the ink jet head according to Embodiment Mode 1 of the present invention, FIG. 3 is a plan view diagram of FIG. 2, FIGS. 4A and 4B are schematic perspective diagrams of a head tip, and FIG. 5 is a cross sectional diagram of FIG. 3 taken along a line segment A–A'.

As shown in the figures, the ink jet heads 20 according to this embodiment mode have a head tip 30, a flow path substrate 40 provided in one surface side of the head tip 30, a negative pressure regulation portion 60 that is a portion of ink storing means connected to the flow path substrate 40, and a wiring substrate 70 on which driver circuits and the like for driving the head tip 30 are mounted. Each of these parts is fixed to a base plate 80.

A plurality of grooves 33 communicating with nozzle apertures 32 are disposed in parallel in a substrate comprised of a piezo-electric ceramic plate 31 that constitutes the head tip 30, and each of the grooves 33 is separated by side walls 34. One end portion in the longitudinal direction of each of the grooves 33 extends up to an end surface of the piezo-electric ceramic plate 31, whereas the other end portion gradually decreases in depth, without extending up to the other end surface. Further, electrodes 35 used for applying a driver voltage are formed in side walls 34 on both sides in the transverse direction of each of the grooves 33, extending in the longitudinal direction on the aperture side of the grooves 33.

Note that each of the grooves 33 formed in the piezo-electric ceramic plate 31 is formed by disk shaped dice cutter, for example. The portions where the depth gradually becomes shallower are formed by the shape of a dice cutter. Further, the electrodes 35 formed within each of the grooves 33 are formed by a known evaporation process from an inclined direction, for example.

One end of an external wiring 90 such as a flexible printed circuit (FPC) or the like is joined to the electrodes 35 formed on the aperture side of the side walls 34 in both sides of the grooves 33. By joining the other end side of the external wiring 90 to a driver circuit, which is not shown in the figure, on the wiring substrate 70, the electrodes 35 are electrically connected to the driver circuit.

Further, an ink chamber plate 36 is joined to the aperture side of the grooves 33 of the piezo-electric ceramic plate 31. A common ink chamber 37 that is formed passing completely through the ink chamber plate 36 is provided extending over the entirety of the grooves 33 aligned in parallel.

Note that the ink chamber plate 36 can be formed of a ceramic plate, a metal plate, and the like, and when considering changes in shape after joining the ink chamber plate 36 to the piezo-electric ceramic plate 31, it is preferable to use a ceramic plate having a similar thermal expansion coefficient.

Further, a nozzle plate 38 is joined to an end surface where the grooves of the junction between the piezo-electric ceramic plate 31 and the ink chamber plate 37 open, and the nozzle apertures 32 are formed in locations opposing each of the grooves 33 of the nozzle plate 38.

The nozzle plate 38 is larger than the surface area of the end surfaces where the grooves 33 of the junction of the piezo-electric ceramic plate 31 and the ink chamber plate 36 are open in this embodiment mode. The nozzle plate 38 is one in which the nozzle apertures 32 are formed in a polyimide film or the like by using an excimer laser apparatus, for example. Further, although not shown in the figures, a water repellent film having water repellent characteristics is formed in a surface opposing the print of the nozzle plate 38 in order to prevent ink adhesion and the like.

Further, in this embodiment mode a nozzle support plate 33 is joined to a peripheral surface of the end side where the grooves 33 of the junction between the piezo-electric ceramic plate 31 and the ink chamber plate 36 open. Note that the nozzle support plate 39 is joined to the outside of the end surface of the junction with the nozzle plate 38, and is provided for stabilizing and supporting the nozzle plate 38.

Note that the surface of the head tip 30 having this type of structure, on the side opposite to that of the ink chamber plate 36 of the piezo-electric ceramic plate 31, is joined and fixed to the base plate 80.

Further, the flow path substrate 40 is joined to one surface of the ink chamber plate 36 of the head tip 30 through an O-ring or the like, for example, and one surface of the common ink chamber 37 is sealed by the flow path substrate 40.

In addition, a connecting portion that is discussed later and is connected to an ink connection tube 61, which is formed by a stainless tube or the like, is provided in an upper surface of the flow path substrate 40. The negative pressure regulating portion 60, which temporarily stores a predetermined amount of ink and which is connected to an ink cartridge 100 through an ink supply tube 101, is formed in the other end side of the ink connection tube 61, one end of which is connected to this connection portion.

The negative pressure regulation portion 60 performs pressure regulation of ink within the common ink chamber 37 of the head tip 30, and within the grooves 33. In detail, the pressure within the head tip 30 changes when the ink jet heads 20 move in the main scanning direction, and there is a danger that a meniscus formed by surface tension of the ink in the nozzle apertures 32 will rupture. By regulating pressure changes within the head tip 30 by using the negative pressure regulation portion 60, a stable meniscus can be maintained, and the ink can be discharged. Further, by storing a predetermined amount of ink therein, the negative pressure regulation portion 60 also contributes to air bubble storage that prevents air bubbles within the ink supply tube 101 from mixing in with the head tip 30.

The flow path substrate 40 to which the negative pressure regulation portion 60 is connected through the connection tube 61 is explained in detail here while referring to FIG. 5.

As shown in FIG. 5, the flow path substrate 40 is provided with a flow path main body 42 that has an ink reservoir 41 formed extending in the direction in which the nozzle apertures 32 are aligned in parallel, a tubular connecting portion 43 formed in a center portion of the flow path main body 42 in the direction in which the nozzle apertures 32 are arranged in parallel, and a filter 44 disposed within the ink reservoir 41 in this embodiment mode.

The connecting portion 43, to which the ink connection tube 61 is coupled, is formed protruding in the center portion of an upper surface of the flow path main body 42, along the base plate 80. Further, the tubular communicating passage 45 is formed passing completely through the connection portion 43 in an axial direction. One end side of the communicating passage 45 is connected to the negative pressure regulation portion 60 through the ink connection tube 61, and the other end side is connected to an ink introduction passage discussed later. Note that the inner diameter of the communicating passage 45 is set to Φ4.0 mm, for example, in this embodiment mode.

Further, the ink reservoir 41 that constitutes a portion of the ink flow path connecting the negative pressure regulating portion 60 and the common ink chamber 37 of the head tip 30 is formed in the flow path main body 42 extending in the direction in which the grooves 33 are aligned in parallel. That is, the ink reservoir 41 is defined by partitions 46*a* and 46*b* that are formed extending in the direction in which the grooves 33 are aligned in parallel.

The filter 44 is disposed within the ink reservoir 41 of the flow path main body 42 extending in the direction in the grooves 33 are arranged in parallel. The filter 44 is disposed in a vertical direction in this embodiment, for example, that is along the base plate 80. A finely meshed filter formed by using stainless steel (SUS), plastic, a resin material, or the like can be given as an example of this type of filter. Note that the filter 44 also acts to generate a back pressure in each of the grooves 33 when ink is discharged, and it is necessary to maintain a certain amount of surface area in contact with the ink.

Further, the partitions 46*a* and 46*b* that mutually oppose the filter 44 are formed before and after the filter 44 in the flow path, extending in the direction in which the grooves 33 are aligned in parallel. Thin plate shaped spaces are thus defined in an upstream side and a downstream side of the ink flow path by each of the partitions 46*a* and 46*b*, and the filter 44, within the ink reservoir 41. That is, an upstream space 47 of an upstream side, and a downstream space 48 of a downstream side, are defined.

In addition, a thin plate shaped ink introduction passage 49 is connected to one end side of the filter 44 of the upstream space 47, that is, to one end side in the longitudinal direction of the filter 44, in a direction that is orthogonal to the direction in which the grooves 33 are aligned in parallel. The ink introduction passage 49 is connected at a lower portion side in the vertical direction of the upstream space 47, for example, in this embodiment mode.

On the other hand, a thin plate shaped ink supply passage 50 for supplying ink to the common ink chamber 37 is connected to the other end side of the filter 44 of the downstream space 48, that is to the other end side in the longitudinal direction of the filter 44, extending in the direction in which the grooves 33 are aligned in parallel. The ink supply passage 50 is connected at an upper portion side in the vertical direction of the downstream space 48, for example, in this embodiment mode.

Dimensions x (mm) in the thickness direction of the thin plate shape of the upstream space 47, the downstream space 48, the ink introduction passage 49, and the ink supply passage 50 are smaller than an inner diameter y of the communicating passage 45. That is, the dimensions satisfy the condition that $x<y$. Further, it is preferable that the relationship between each of the dimensions x in the thickness direction of the upstream space 47, the downstream space 48, the ink introduction passage 49, and the ink supply passage 50, and the inner diameter y of the communicating passage 45, satisfy the condition that $x \leqq 1.0$, and more preferably, that all of the dimensions x be the same size. In this embodiment mode $x=1.0$ mm.

Ink volumetric changes in the ink flow path from the communicating passage 45 up to the common ink chamber 37 can be made substantially smaller during ink filling operations such as an initial filling, for example, by thus making the dimensions x in the thick plate-shape thickness direction of the upstream space 47, the downstream space 48, the ink introduction passage 49, and the ink supply passage 50 smaller than the inner diameter y of the communicating passage 45.

Specifically, the ink flow path expands when ink flows in from the communicating passage 45 to the ink introduction passage 49, that is the flow path of the ink introduction passage 49 has a thin plate shape and therefore expands in the direction in which the grooves 33 are aligned in parallel, but by making the dimension x in the thin plate-shape thickness direction of the ink introduction passage 49 smaller than the inner diameter y of the communicating passage 45, the ink flow path can be narrowed down in this direction. Volumetric changes of the ink when the ink flows in from the communicating passage 45 to the ink introduction passage 49 can therefore be made smaller.

Further, if ink flows in from the ink introduction passage 49 to the upstream space 47, then the upstream space 47 defines a flow path for upward flow along the filter 44, and a flow path for flow into the downstream space 48 through the filter 44. The ink introduction passage 49 and the upstream space 47 are connected extending in the direction in which the grooves 33 are arranged in parallel in this embodiment mode, and the upstream space 47 is given a thin plate shape having a thickness identical to that of the ink introduction passage 49. In addition, the downstream space 48 is also made into a thin plate shape having the identical thickness, and therefore volumetric changes in the ink flow path are made substantially smaller, and ink flow rate reductions are suppressed.

Air bubbles that develop within the ink reservoir 41, the common ink chamber 37, or within each of the grooves 33 during the ink filling operation can therefore be discharged efficiently from each of the nozzle apertures 32. That is, after the ink filling operation, air bubbles that remain within the ink reservoir 41, the common ink chamber 37, or within each of the grooves 33 can be suppressed to a minimum.

Further, the filter 44 is disposed in a vertical direction to define the thin plate shaped upstream space 47 and the thin plate shaped downstream space 48, the ink introduction passage 49 is connected at the lower portion in the vertical direction of the upstream space 47, and the ink supply passage 50 is connected at the upper portion in the vertical direction of the downstream space 48, thus making a flow path structure in which the flow of air bubbles is not backwards in this embodiment mode. Air bubbles can therefore be effectively prevented from remaining within the ink reservoir 41, the common ink chamber 37, or within each of the grooves 33 during the ink filling operation.

Reductions and dispersions in the ink discharge characteristics that develop due to air bubbles remaining within the ink flow path of the head can therefore be prevented, and the printing quality can be improved, with the ink jet head 20 of the present invention.

Further, air bubbles can be prevented from remaining within the ink reservoir 41, the common ink chamber 37, and within each of the grooves 33, and therefore printing failure in which the air bubbles are discharged from the nozzle apertures 32 along with the ink during ink discharge, for example, can be prevented.

In addition, by setting each of the dimensions x in the thickness direction of the upstream space 47, the downstream space 48, the ink introduction passage 49, and the ink supply passage 50 to an identical value in this embodiment mode, and by setting each of the dimensions x to be 1.0 mm, volumetric changes in the ink can be made even smaller. The remainder of air bubbles can therefore be very effectively prevented, and the printing quality can be further improved.

Note that air bubbles can be effectively prevented from remaining after the ink filling operation for cases like this embodiment mode where water based ink, in which the permeability of air bubbles with respect to the ink is poor, is used as a type of the ink employed in the heads, and for cases of using large sized heads in which the amount of ink discharged with a unit period of time is large, provided that the present invention is applied.

Embodiment Mode 2

Figure 6:
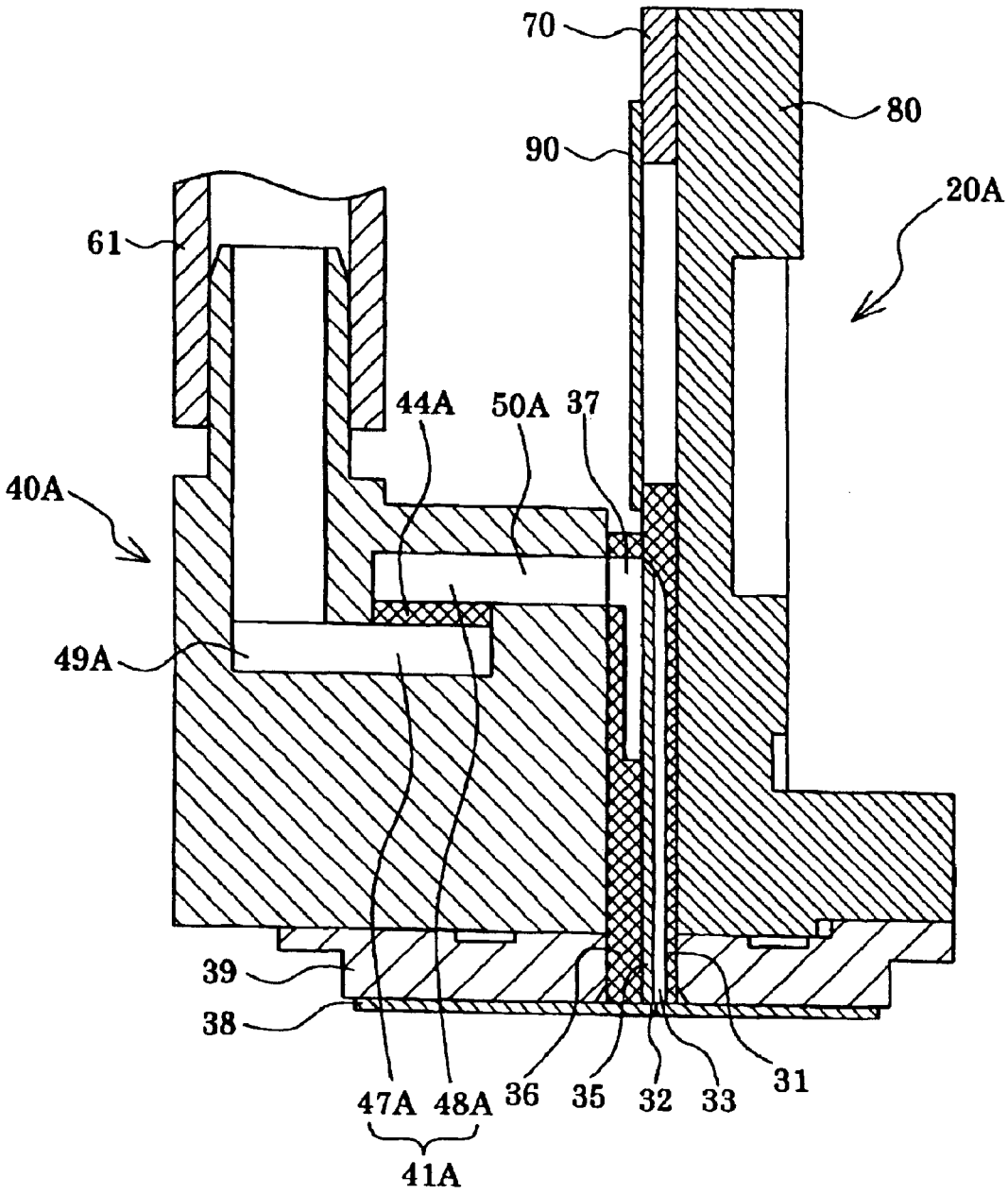
FIG. 6 is a blow-up cross sectional diagram of main portions of an ink jet head according to Embodiment Mode 2 of the present invention.

FIG. 6 is a blow-up cross sectional diagram of main portions of an ink jet head according to Embodiment Mode 2 of the present invention.

This embodiment mode is an example of an ink jet head 20A in which a filter 44A is disposed in a horizontal direction as shown in FIG. 6. Note that identical reference numerals are appended to portions of FIG. 6 that are identical to those of Embodiment Mode 1 described above, and that repetitive explanations are omitted.

Specifically, the ink jet head 20A of this embodiment mode is provided with a flow path substrate 40A on which the filter 44A is disposed in a horizontal direction within an ink reservoir 41A, an upstream space 47A is defined in a lower side in a vertical direction of the filter 44A, and a downstream space 48A is defined in an upper side in the vertical direction of the filter 44A. An ink introduction passage 49A is connected to the upstream space 47A at one end side in a horizontal direction, and an ink supply passage 50A is connected to the downstream space 48A at the other end side in the horizontal direction.

Similar to Embodiment Mode 1 discussed above, air bubbles remaining within the ink reservoir 41A, the common ink chamber 37, or within each of the grooves 32 after the ink filling operation can also be suppressed to a minimum with the flow path substrate 40A having this type of flow path structure, and reductions and dispersions in ink discharge characteristics that develop due to the remaining air bubbles can be prevented, and printing failure can also be prevented. The printing quality can therefore be improved.

Embodiment Mode 3

Figure 7:
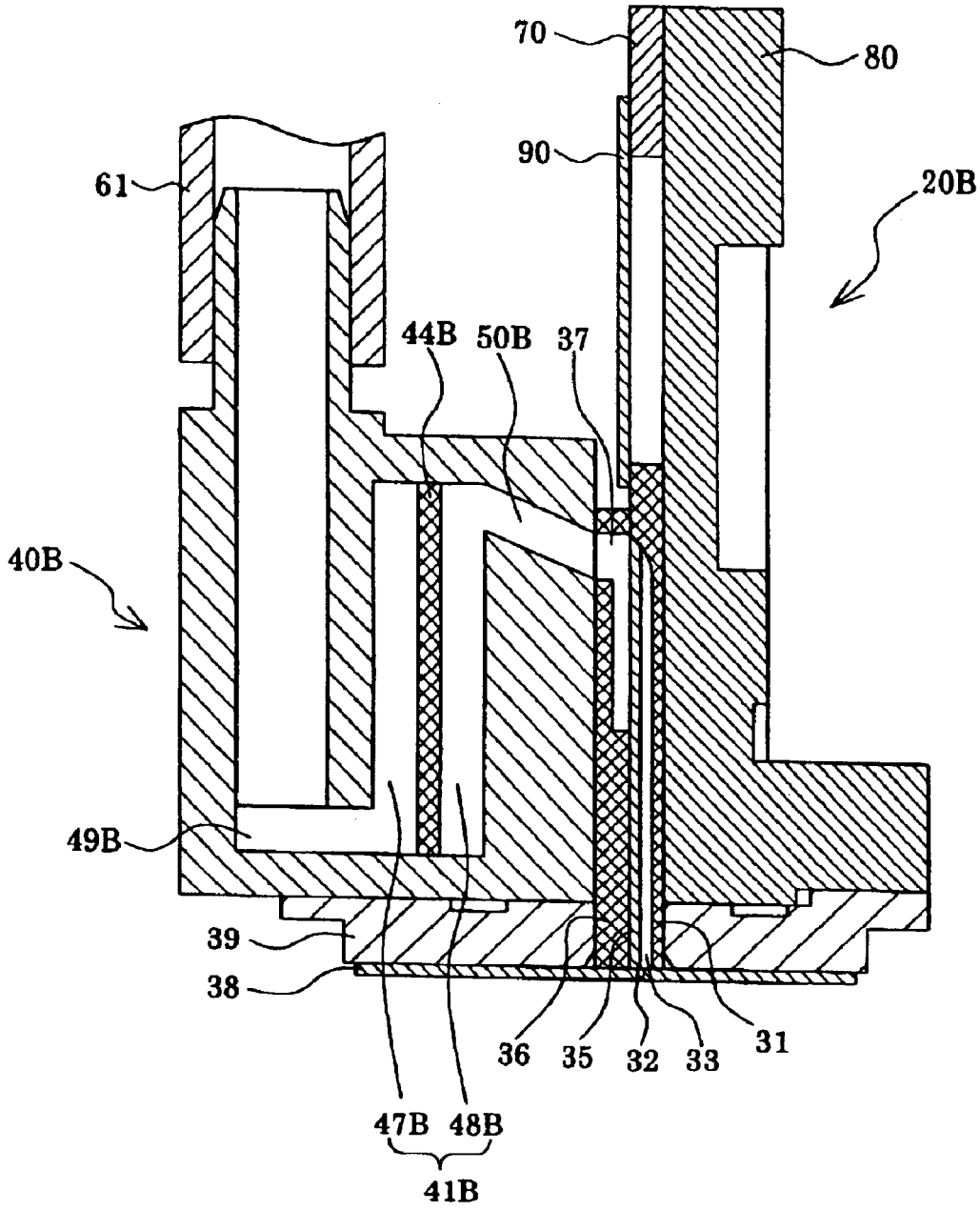
FIG. 7 is a blow-up cross sectional diagram of main portions of an ink jet head according to Embodiment Mode 3 of the present invention.

FIG. 7 is a blow-up cross sectional diagram of main portions of an ink jet head according to Embodiment Mode 3 of the present invention.

This embodiment mode is an example of an ink jet head 20B in which an end side of an ink supply passage 50B, opposite to one end of the ink supply passage 50B that is connected to a downstream space 48B, is inclined downward in a vertical direction by a predetermined amount and connected to the common ink chamber 37, as shown in FIG. 7. Note that identical reference numerals are appended to portions of FIG. 7 that are identical to those of Embodiment Mode 1 described above, and that repetitive explanations are omitted.

The actions and effects of the above described embodiment modes can also be obtained with the flow path substrate 40B having this type of flow structure, and further, the few air bubbles remaining in the vicinity of an entrance to the common ink chamber 37 after the ink filling operation can be moved substantially away from the grooves 33.

Specifically, by using a flow path structure in which the other end side of the ink supply passage 50B is inclined downward in the vertical direction, air bubbles that remain in each of the grooves 33 or in the vicinity of the entrance to the common ink chamber 37 are made to flow toward the downstream space 48B side, and the air bubbles can thus be moved substantially away from the grooves 33. Air bubbles can therefore be prevented from remaining with each of the grooves 33 with certainty, and harmful influence imparted to a head vibration system can be prevented with certainty.

Further, there is also an action for moving not only air bubbles generated immediately after ink filling operations but also air bubbles generated thereafter by head driving and the like far away, for example, with this embodiment mode. Stable ink discharge characteristics can thus be obtained.

Other Embodiment Modes

Figure 8:
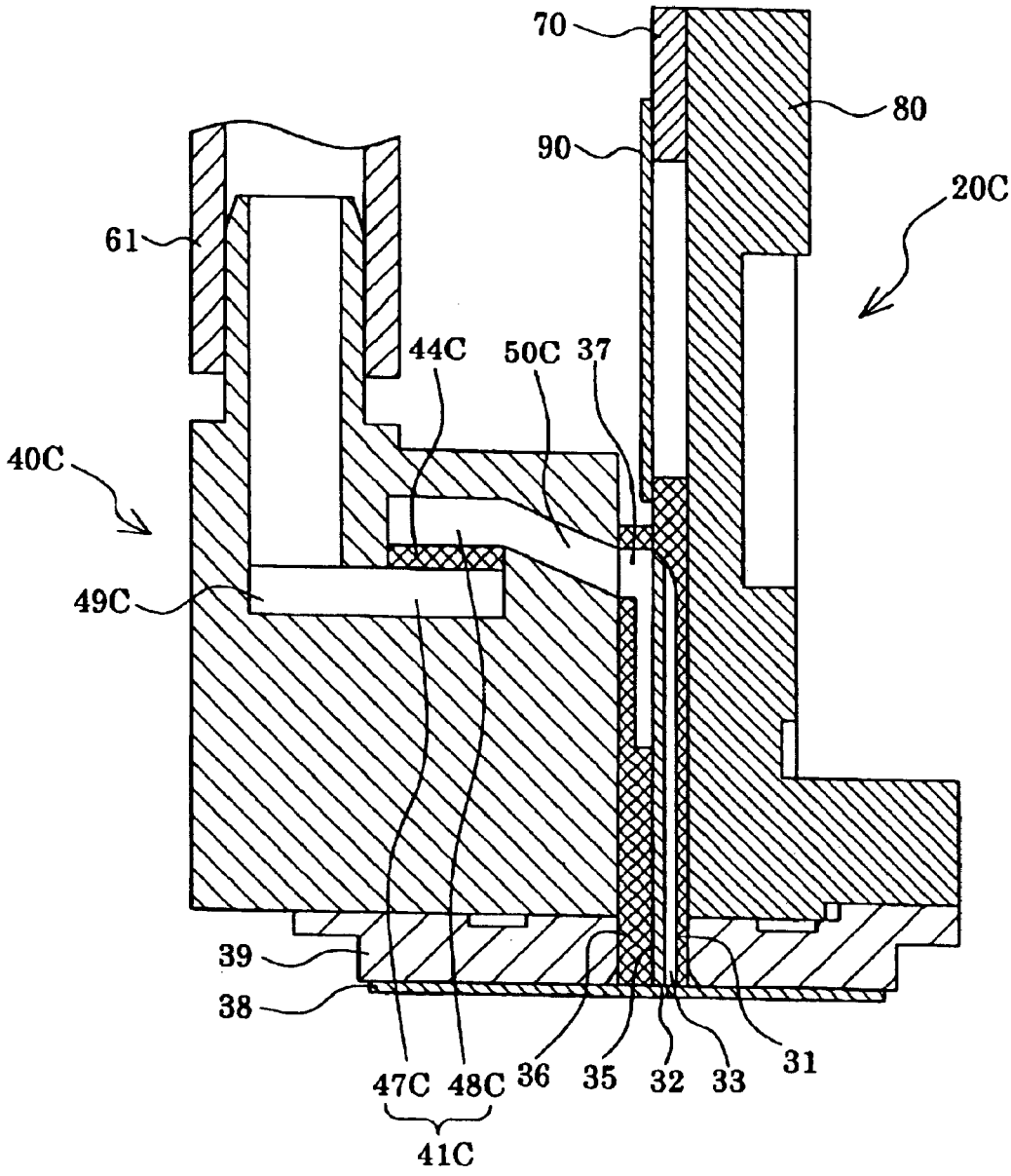
FIG. 8 is a diagram showing an alternative example of a flow path structure of an ink jet head according to another embodiment mode of the present invention.

Embodiment Modes 1 to 3 of the present invention are explained above, but the ink jet head and the ink jet recording device of the present invention are not limited to these types of structures. Note that FIGS. 8 to 10 are diagrams showing alternative examples of a flow path structure of an ink jet head according to other embodiment modes of the present invention.

For example, the ink jet head 20B in which the filter 44B is disposed in a vertical direction is shown as an example in Embodiment Mode 3, but the present invention is not limited to this structure, and an ink jet head 20C in which a filter 44C is disposed in a horizontal direction within an ink reservoir 41C may also be used. A flow path structure of the ink jet head 20C is one in which an upstream space 47C is defined in a lower side in a vertical direction of the filter 44C, a downstream space 48C is defined in an upper side of the vertical direction of the filter 44C, an ink introduction passage 49C is connected to the upstream space 47C at one end side in the horizontal direction, and an ink supply passage 50C is connected to the downstream space 48C at the other side in the horizontal direction. Further, similar to Embodiment Mode 3, the ink supply passage 50C is connected to the common ink chamber 37 so that the other end side, opposite to the one end side connected to the downstream space 48C, is inclined downward in the vertical direction by a predetermined amount. Effects similar to those of each of the aforementioned embodiment modes can also be obtained with the flow path substrate 40C having this type of flow path structure.

Figure 9:
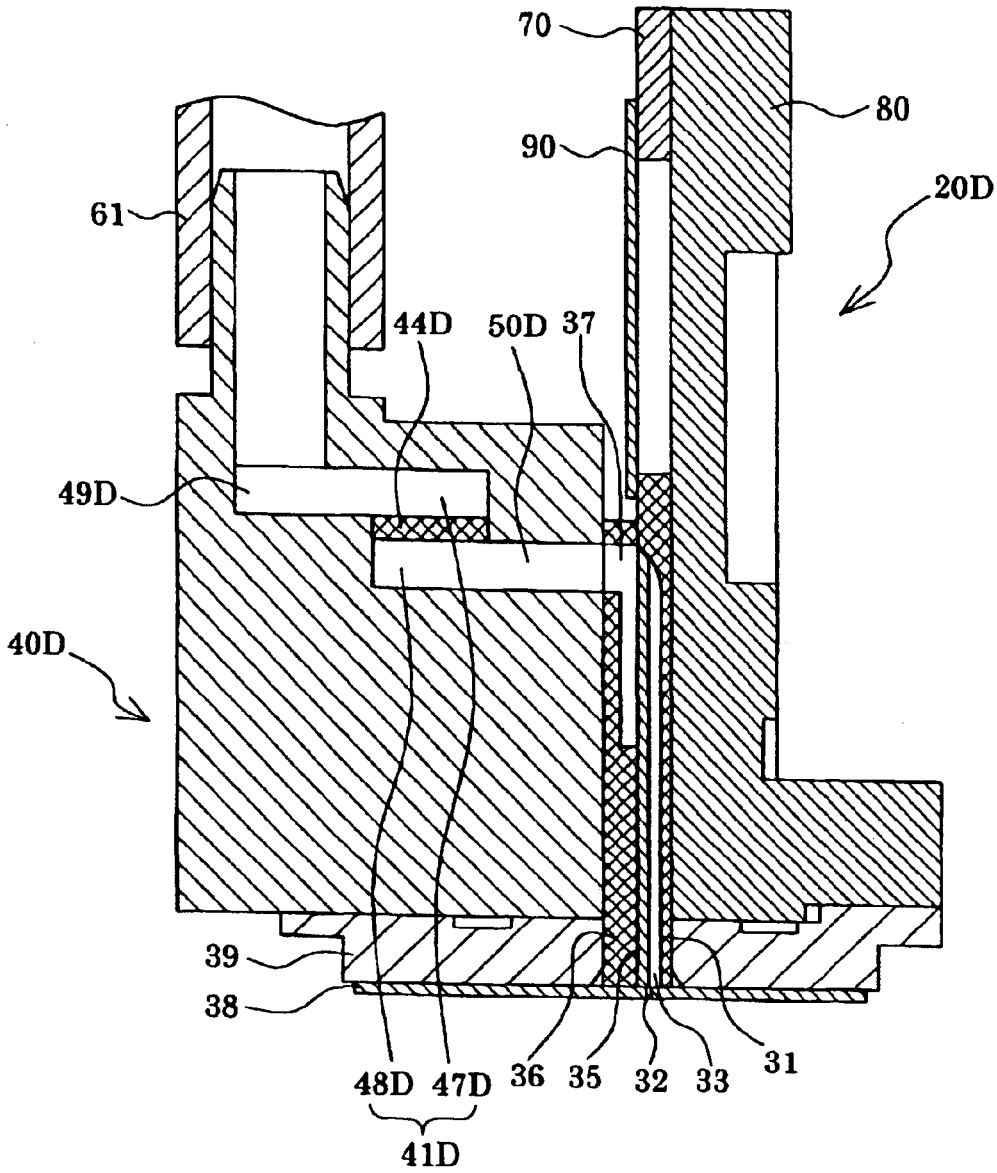
FIG. 9 is a diagram showing an alternative example of a flow path structure of an ink jet head according to another embodiment mode of the present invention.
Figure 10:
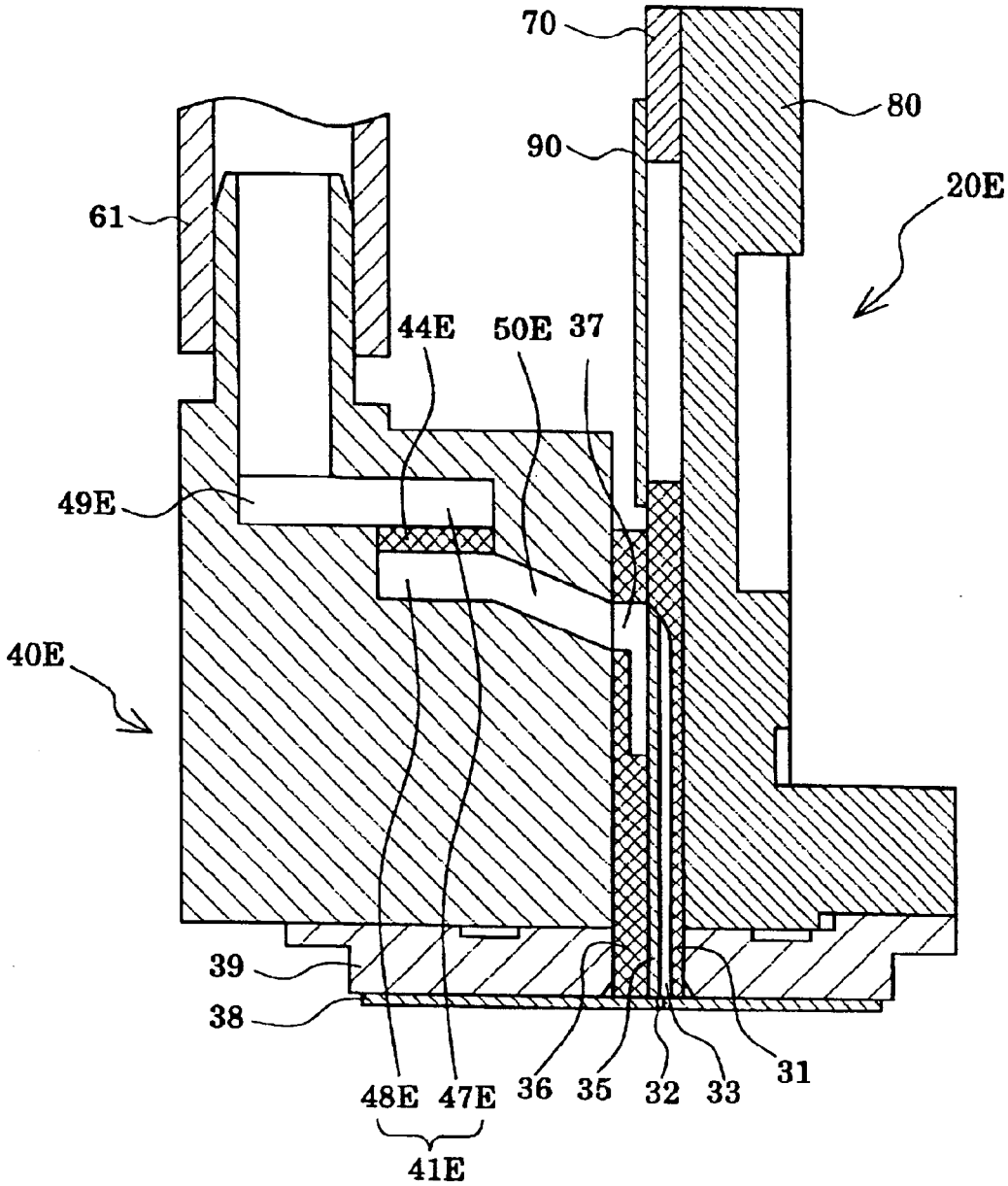
FIG. 10 is a diagram showing an alternative example of a flow path structure of an ink jet head according to another embodiment mode of the present invention.
Figure 11:
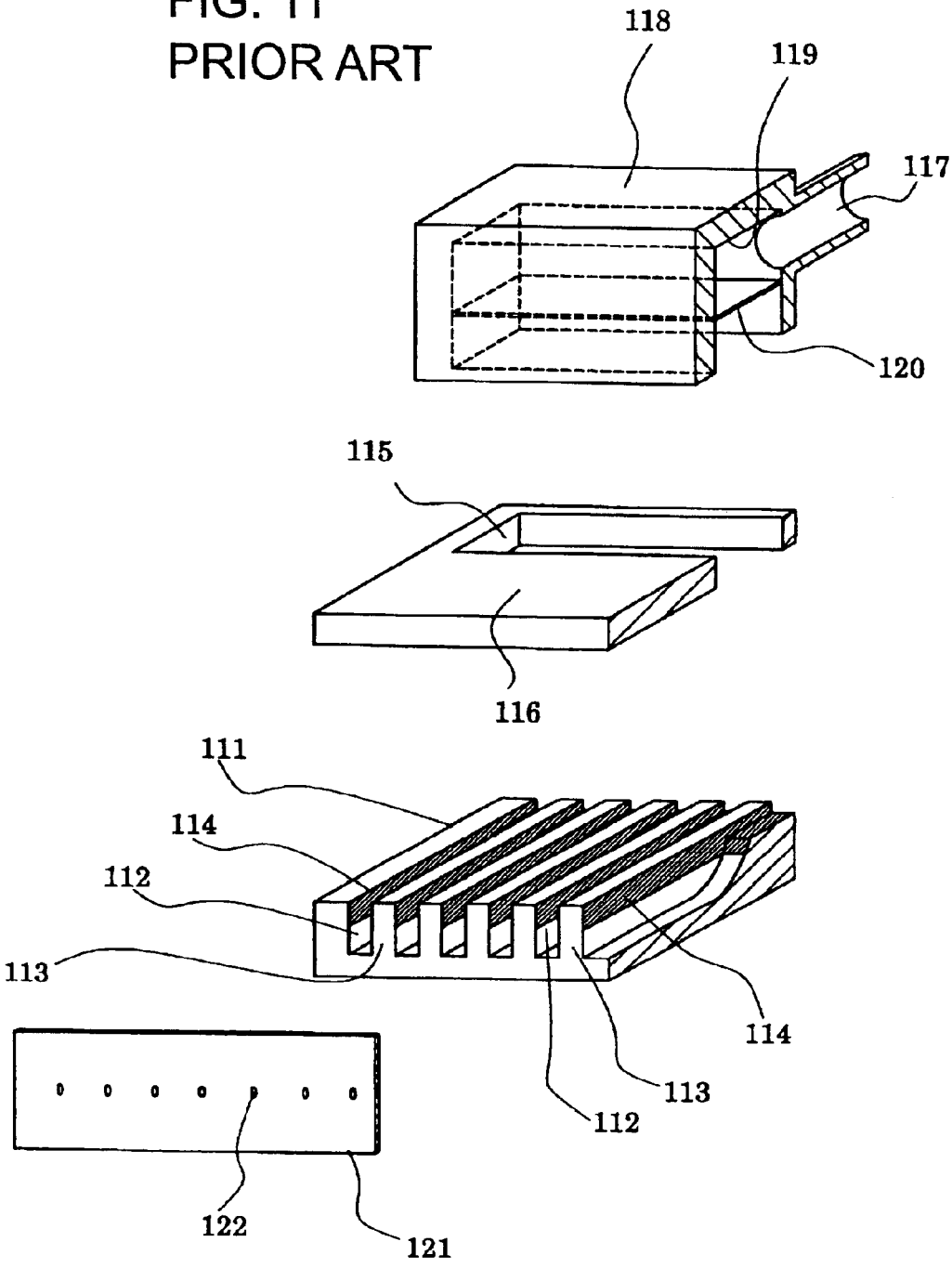
FIG. 11 PRIOR ART
FIG. 11 is an exploded perspective cross sectional diagram showing an example of an ink jet head according to a conventional technique.

Further, the ink jet head 20A having a flow path structure in which the filter 44A is disposed in a horizontal direction, the upstream space 47A is formed at a lower side in a vertical direction of the filter 44A, and the downstream space 48A is formed at an upper side in the vertical direction thereof is shown as an example in Embodiment Mode 2, but an ink jet head 20D having a flow path substrate 40D in which an upstream space 47D is formed at an upper side in a vertical direction of a filter 44D, and a downstream space 48D is formed at a lower side in the vertical direction thereof as shown in FIG. 9 may also be used, provided that the ink velocity is high to a certain extent. An ink introduction passage 49D is connected to the upstream space 47D, and an ink supply passage 50D is connected to the downstream space 48D.

Note that this type of flow path structure, that is a flow path structure in which air bubble movement is backward, can also be applied to the ink jet heads 20 and 20B of Embodiment Modes 1 and 3, respectively, provided that the ink velocity is high. For example, an ink jet head 20E having a flow path substrate 40E in which an upstream space 47E is formed at an upper side in a vertical direction of a filter 44E, a downstream space 48E is formed at a lower side in the vertical direction, an ink introduction passage 49E is connected to the upstream space 47E, an ink supply passage 50E is connected to the common ink chamber 37 such that the other end side, opposite to the one end side connected to the downstream space 48E, is inclined downward in the vertical direction by a predetermined amount, may also be used as shown in FIG. 10.

In addition, although examples of large type ink jet heads for single color printing with one head are shown in Embodiment Modes 1 to 3, the present invention is not limited to this structure, and small type ink jet heads capable of printing in a plurality of colors with one head may also be used.

Note that although the ink jet recording apparatus on which the four color ink cartridge 100 is mounted is shown and explained in Embodiment Mode 1, an ink jet recording apparatus on which a cartridge having from 5 to 8 colors is mounted, for example, may also be used.

With the present invention as explained above, volumetric changes in ink between an upstream space and a downstream space before and after a filter in the ink flow path are made smaller, and ink flow rate reductions are suppressed, and therefore air bubbles remaining within spaces inside a head can be suppressed to a minimum. Reductions and dispersions in ink discharge characteristics can thus be prevented, printing failure can be prevented, and the printing quality can be improved

What is claimed is:

1. An ink let head comprising:

a substrate having a plurality of grooves each for receiving ink and extending along a longitudinal direction;

a nozzle plate connected to the substrate and having a plurality of nozzle apertures each disposed in communication with respective ones of the grooves;

ink storing means for storing ink;

an ink chamber plate connected to the substrate and having an ink chamber for supplying ink from the ink storing means to the grooves;

means defining an ink flow path for transporting ink from the ink storing means to the ink chamber of the ink chamber plate;

a filter disposed in the ink flow path in a direction generally perpendicular to the longitudinal direction of each of the grooves; and a flow path substrate connected between the ink storing means and the ink chamber plate, at least portions of the ink flow path being formed in the flowpath substrate, the ink flow path having a tubular communicating passage having a first end connected to the ink storing means and a second end, an ink reservoir in which the filter is disposed to divide the ink reservoir into an upstream space disposed on a lower side of the filter and a downstream space disposed on an upper side of the filter opposite, the lower side, an ink introduction passage for transporting ink along a flow direction generally perpendicular to the longitudinal direction of each of the grooves and having a first end connected to the second end of the tubular communicating passage and a second end connected to the upstream space, an ink supply passage having a first end connected to the downstream space and a second end connected to the ink chamber plate for supplying ink to the ink chamber, the ink supply passage being inclined downwardly relative to a horizontal line disposed generally parallel to the flow direction of ink in the ink introduction passage, and each of the ink introduction passage, the ink supply passage, the upstream space, and the downstream space having a thickness smaller than an inner diameter of the tubular communicating passage.

2. An ink jet head according to claim 1; wherein the thicknesses of the ink introduction passage, the ink supply passage, the upstream space, and the downstream space are equal to one another.

3. An ink jet head according to claim 1; wherein the thickness of each of the ink introduction passage, the ink supply passage, the upstream space, and the downstream space is equal to or less than 1.0 mm.

4. An ink jet recording apparatus having the ink jet head according to claim 1.

5. An ink jet head comprising:

a first substrate having a plurality of partition walls spaced apart at a preselected interval to form a plurality of parallel grooves each for receiving ink and extending along a longitudinal direction;

an ink storing member far storing ink;

an ink chamber plate connected to the first substrate to define with the partition walls an ink chamber for supplying ink stored in the ink storing member to the grooves; and a second substrate connected between the ink storing member and the ink chamber plate, the second substrate having an ink flow path for transporting ink from the ink storing member to the ink chamber of the ink chamber plate and a filter disposed in a portion of the ink flow path in a direction generally perpendicular to the longitudinal direction of each of the grooves, the ink flow path having a communicating passage having a first end connected to the ink storing member and a second end, an ink reservoir in which the filter is disposed to divide the ink reservoir into an upstream space disposed on a lower side of the filter and a downstream space disposed on an upper side of the filter opposite the lower side, an ink introduction passage for transporting ink along a flow direction generally perpendicular to the longitudinal direction of each of the grooves and having a first end connected to the second end of the communicating passage and a second end connected to the upstream space, and an ink supply passage having a first end connected to the downstream space and a second end connected to the ink chamber plate for supplying ink to the ink chamber, the ink supply passage being inclined downwardly toward the ink chamber of the ink chamber plate relative to a horizontal line disposed generally parallel to the flow direction of ink in the ink introduction passage.

6. An ink jet head according to claim 5; further comprising a nozzle plate connected to the first substrate and having a plurality of nozzle apertures each disposed in communication with respective ones of the grooves.

7. An ink jet head according to claim 5; wherein each of the ink introduction passage, the ink supply passage, the upstream space, and the downstream space has a thickness smaller than an inner diameter of the communicating passage.

8. An ink jet head according to claim 7; wherein the thicknesses of the ink introduction passage, the ink supply passage, the upstream space, and the downstream space are equal to one another.

9. An ink jet head according to claim 8; wherein the thickness of each of the ink introduction passage, the ink supply passage, the upstream space, and the downstream space is equal to or less than 1.0 mm.

10. An ink jet recording apparatus having the ink jet head according to claim 5.

11. An ink jet head comprising: means defining a plurality of parallel grooves each extending along a longitudinal direction on for receiving ink stored in an ink storing member, an ink chamber disposed in communication with the grooves, and an ink flow path for transporting ink to the grooves via an ink chamber, the ink flow path having a communicating passage connected to the ink storing member, an ink introduction passage connected to the communicating passage for transporting ink along a flow direction generally perpendicular to a longitudinal direction of each of the grooves, an ink reservoir connected to the ink introduction passage, and an ink supply passage connected to the ink reservoir for supplying ink to the ink chamber, the ink supply passage being inclined downwardly toward the ink chamber relative to a horizontal line disposed generally parallel to the flow direction of ink in the ink introduction passage; and a filter disposed in the ink reservoir in a direction generally perpendicular to the longitudinal direction of each of the grooves for filtering the ink supplied to the ink chamber.

12. An ink jet head according to claim 11; wherein the filter divides the ink reservoir into an upstream space disposed on a first side of the filter and a downstream space disposed on a second side of the filter opposite the first side; and wherein each of the ink introduction passage, the ink supply passage, the upstream space, and the downstream space has a thickness smaller than an inner diameter of the communicating passage.

13. An ink jet head according to claim 12; wherein the thicknesses of the ink introduction passage, the ink supply passage, the upstream space, and the downstream space are equal to one another.

14. An ink jet head according to claim 13; wherein the thickness of each of the ink introduction passage, the ink supply passage, the upstream space, and the downstream space is equal to or less than 1.0 mm.

* * * * *